US009862586B2

(12) United States Patent
Krulitsch

(10) Patent No.: US 9,862,586 B2
(45) Date of Patent: Jan. 9, 2018

(54) FILLING ELEMENT AND FILLING MACHINE FOR FILLING BOTTLES OR SIMILAR CONTAINERS

(75) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 462 days.

(21) Appl. No.: 13/702,240

(22) PCT Filed: May 5, 2011

(86) PCT No.: PCT/EP2011/002231

§ 371 (c)(1),
(2), (4) Date: Dec. 5, 2012

(87) PCT Pub. No.: WO2011/154074

PCT Pub. Date: Dec. 15, 2011

(65) Prior Publication Data

US 2013/0074979 A1 Mar. 28, 2013

(30) Foreign Application Priority Data

Jun. 7, 2010 (DE) ..... 10 2010 022 875

(51) Int. Cl.
*B67C 3/26* (2006.01)
*B65B 3/10* (2006.01)

(52) U.S. Cl.
CPC ..... *B67C 3/2608* (2013.01); *B65B 3/10* (2013.01); *B67C 2003/268* (2013.01); *B67C 2003/2645* (2013.01)

(58) Field of Classification Search
CPC ..... B67C 2003/268; B67C 2003/2677; B67C 2003/2674; B67C 3/26; B67C 3/2608; B67C 2003/2645
USPC ..... 141/57, 144–147, 285–287; 239/382, 239/383, 399; D23/413, 414
See application file for complete search history.

(56) References Cited

U.S. PATENT DOCUMENTS 3,464,464 A * 9/1969 Laub ..... 141/59
3,500,879 A * 3/1970 Meyer ..... 141/1
3,556,174 A * 1/1971 Gibble et al. ..... 141/69
3,757,835 A * 9/1973 Copping ..... 141/286
3,782,853 A * 1/1974 Frister ..... 416/132 R
(Continued)

FOREIGN PATENT DOCUMENTS

DE 72 13 885 7/1972
DE 106 330 6/1974
(Continued)

*Primary Examiner* — Timothy L Maust
*Assistant Examiner* — Andrew StClair
(74) *Attorney, Agent, or Firm* — Occhiuti & Rohlicek LLP

(57) ABSTRACT

A filling element for filling a container includes a liquid channel configured in a filling element housing, a connector or inlet for feeding the liquid into the channel, a discharge opening for discharging the liquid into the container, and a liquid valve that controls liquid discharge into the container. The liquid valve is arranged in the channel and includes a valve seat and valve body movable to open and close the valve to engage the seat, and an insert configured as a swirl body or gas barrier. The insert is arranged, relative to a flow direction, upstream of the seat and is fixed in position in the channel so that it remains stationary relative to the valve body during opening and closing of the liquid valve.

12 Claims, 4 Drawing Sheets

(56) References Cited

U.S. PATENT DOCUMENTS

| | | | | | |
|---|---|---|---|---|---|
| 3,799,219 | A | * | 3/1974 | Uth | B67C 3/12 137/386 |
| 4,079,762 | A | * | 3/1978 | Hanson, Jr. | 141/286 |
| 4,101,986 | A | * | 7/1978 | Ng et al. | 4/325 |
| 4,156,444 | A | * | 5/1979 | Mette | 141/286 |
| 4,757,847 | A | * | 7/1988 | Jorss et al. | 141/198 |
| 5,501,253 | A | * | 3/1996 | Weiss | 141/40 |
| D577,807 | S | * | 9/2008 | Kenyon | D23/379 |
| 8,381,777 | B2 | * | 2/2013 | Lupi et al. | 141/48 |
| 8,496,031 | B2 | * | 7/2013 | Jenne | 141/286 |
| 2005/0211332 | A1 | * | 9/2005 | Krulitsch | 141/144 |
| 2010/0083613 | A1 | | 4/2010 | Krulitsch | |

FOREIGN PATENT DOCUMENTS

| | | |
|---|---|---|
| DE | 41 40 524 | 6/1993 |
| DE | 42 09 480 | 9/1993 |
| DE | 94 16 912 | 11/1995 |
| EP | 0 546 346 | 11/1992 |
| EP | 0 562 254 | 9/1993 |
| EP | 1 593 648 | 11/2005 |
| FR | 2 080 060 | 11/1971 |
| FR | 2 848 203 | 11/2004 |
| WO | WO 2010/076816 | 7/2010 |
| WO | WO 2011/007372 | 1/2011 |

* cited by examiner

FILLING ELEMENT AND FILLING MACHINE FOR FILLING BOTTLES OR SIMILAR CONTAINERS

CROSS REFERENCE TO RELATED APPLICATION

This application is the national phase under 35 USC 371 of international application in. PCT/EP2011/002231, filed May 5, 2011, which claims the benefit of the priority date of German application no. 10 2010 022 875.3, filed Jun. 7, 2010. The contents of the aforementioned applications are incorporates herein in their entirety.

FIELD OF DISCLOSURE

The invention relates to a filling element, to an insert for use with filling elements, and to a filling machine.

BACKGROUND

Filling elements having an insert that acts as a gas barrier and/or a swirl body for the filling material are known. Such inserts are typically located in the liquid channel in the direction of flow of the filling material upstream of the valve seat of the liquid valve. These improve the filling material flow when the liquid valve is open or during the filling phase. In known filling elements, the insert moves with the liquid valve when the latter opens and closes.

SUMMARY

A disadvantage of the prior art devices is that when the liquid valve closes, an attached insert amplifies a motion component or acceleration in the direction of the discharge opening. This motion component is imparted to the volume of the liquid filling material that is present between the discharge opening and the valve body or insert. As result of this, an increased residual volume that is additionally introduced into an already filled container. This residual volume arrives with increased kinetic energy. If the filling material happens to be carbonated, the resulting agitation causes frothing.

An object of the invention is a filling element that avoids the disadvantages of known filling elements while retaining the fundamental advantages of an insert that acts as a gas barrier and/or a swirl body.

The apparatus disclosed herein has been found to significantly enhance the properties of a filling element. In particular, the apparatus reduces velocity or acceleration of the residual or overrun volume that is still being introduced into a container during the closing of the liquid valve.

Further embodiments, advantages, and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

The invention is explained in detail below through the use of an embodiment example with reference to the figures.

DETAILED DESCRIPTION

Figure 1:
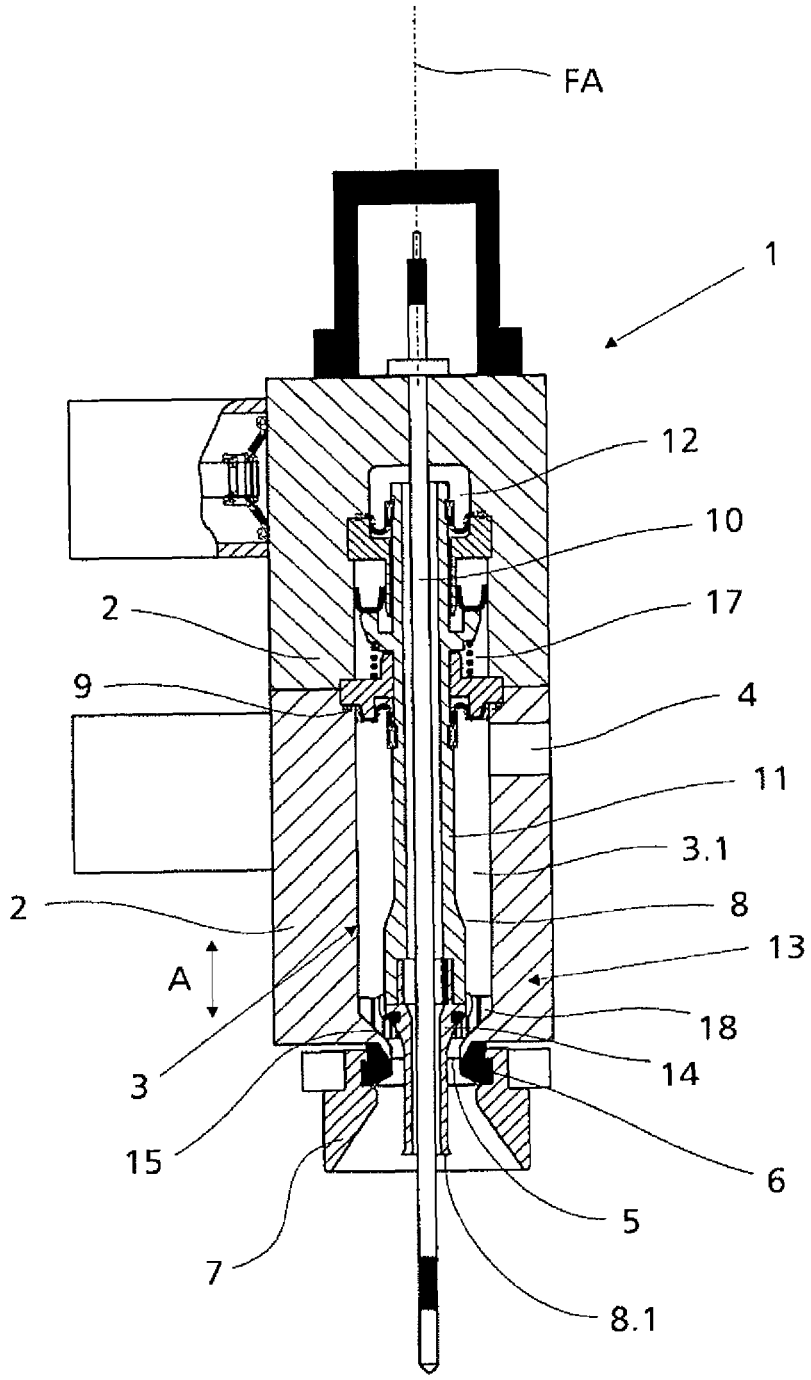
FIG. 1 shows a simplified partial representation and a cross-section a filling element according to the invention for filling containers or bottles with a liquid product or filling material.

FIG. 1 shows an exemplary filling valve 1 from a filling system having a plurality of such valves. An example of such filling systems is a rotary-type filling machine in which filling elements 1 are provided on the periphery of a rotor that can be driven to rotate about a vertical machine axis.

The illustrated filling element 1 has a multisection filling element housing 2 having a recess 3.1 that forms a liquid channel 3 for the liquid filling material. In the region of its upper end, a connector or inlet 4 connects the liquid channel 3 to a line or tank for feeding the liquid filling material. In the region of its lower end or at the base of the filling element housing 2, i.e. at a conically narrowing section of the recess 3.1, the housing forms an annular discharge opening 5 that concentrically encircles a vertical filling-element axis FA. During filling, liquid filling material flows through this opening 5 and into the container.

During filling, in particular during pressure filling, the container lies against the filling element 1 in a sealed position. In particular, the container lies with its mouth edge or mouth bead against a seal 6 at the base of the filling element housing 2. This seal 6 annularly encircles the discharge opening 5. In the illustrated embodiment, the seal 6 forms part of a centering tulip 7 for centering the container relative to the filling element 1.

A gas tube 8 extends downward along the filling-element axis FA and through the liquid channel 3. An open lower end 8.1 of the gas tube 8 projects beyond the discharge opening 5 and the ring seal 6. An open upper end of the gas tube 8 continues upward past a seal 9 at the top of liquid channel 3. In the illustrated embodiment, the seal 9 is a membrane.

A rod-like probe 10 determines the fill level during filling of the container. The rod-like probe 10 extends along the filling-element axis FA, extends through the gas tube 8, and projects out of the gas tube's lower end 8.1. The probe 10 and the gas tube 8 form an annular gas channel 11 that encircles the probe 10 inside the gas tube 8. This gas channel 11 opens at the gas tube's lower end 8.1. It also opens into a chamber 12 at the gas tube's upper end. Like the gas channel 11, the chamber 12 is part of the gas paths of filling element 1 that control the filling process.

The gas tube 9 has a relatively short lower partial-length that is accommodated within the liquid channel 3. This lower partial-length forms a valve body 14. The valve body 14 has a a circular-cylindrical peripheral surface that concentrically encloses the filling-element axis FA.

A conical interior surface 16 of a tapering lower section of the recess 3.1 defines a valve seat 15. The valve body 14 and the valve seat 15 together define a liquid valve 13 that transitions between an open and closed position. In the closed position, the valve body 14 engages the valve seat 15.

An actuator, such as a pneumatic actuator 17, opens and closes the liquid valve 13 by moving the gas tube 8 up and down along the filling-element axis FA, as shown by the double-arrow A. It does so in response to, for example, a signal from the probe 10.

The filling element 1 fills containers by pressure filling or counter-pressure filling. In either case, after having been pre-evacuated and purged with an inert gas, a container that is sealed against the filling element 1 is pre-stressed and pressure-filled. At the end of the filling process, the pressure is at least partially reduced to ambient pressure by the gas channel 11.

Referring to FIGS. 3-6, the filling element 1 includes an annular insert 18 that acts as a gas barrier and as a swirl body. The insert 18 is arranged in the liquid channel 3, and in particular, at the lower conically narrowing section of the recess 3.1 that forms liquid channel 3. It is also fixed in its position. As a result, it does not move with valve body 14 during the opening and closing of liquid valve 13. In the illustrated embodiment, the insert 18 lies against a conical interior surface 16 at a region upstream of the valve seat 15 relative to the direction of flow of the liquid filling material. The insert 18 is therefore inside that part of the liquid channel 3 that is separated by the valve from the discharge opening 5 when closing the liquid valve 13.

As depicted in particular in FIG. 3-6, the insert 18 is manufactured as a shaped body from a suitable material. The material can be plastic or metal.

Figure 3:
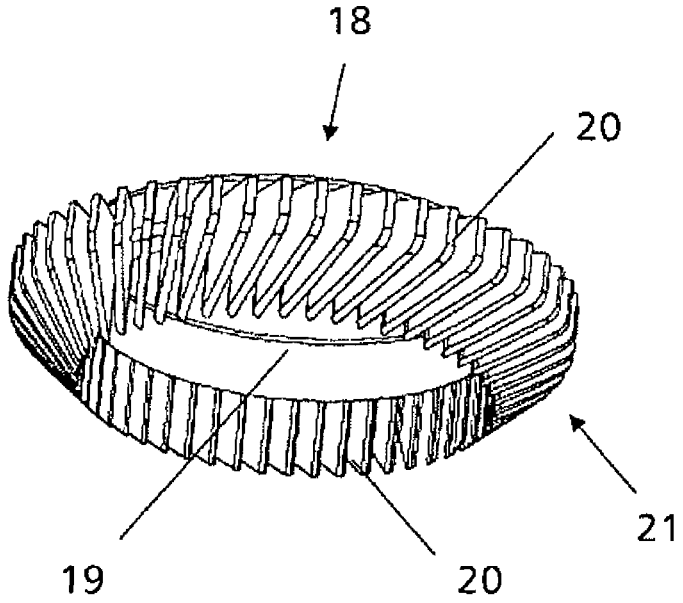
FIGS. 3 and 4 each show, in perspective representation and from below (FIG. 3) and above (FIG. 4) a ring-shaped insert for use with the filling element shown in FIGS. 1 and 2.
Figure 4:
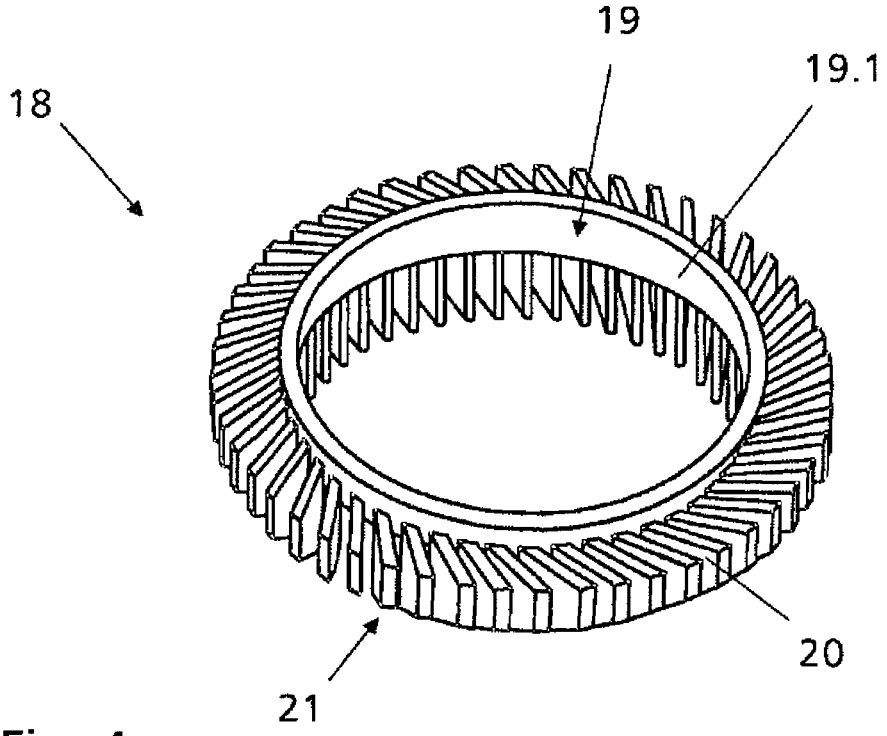
Figure 6:
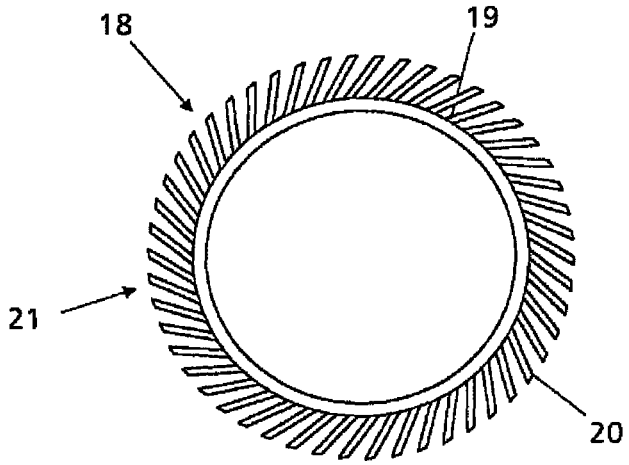

Referring to FIG. 3, in one embodiment, the insert 18 is a single piece having a ring 19. A plurality of blades 20 or blade-like wall sections extend along a direction that has a component that is radially outward from the ring 19. As shown in FIG. 6, each blade 20 has a radially inner edge and a radially outer edge. The radially inner edge is supported by the ring 19. The radially outer edge is unsupported.

Figure 5:
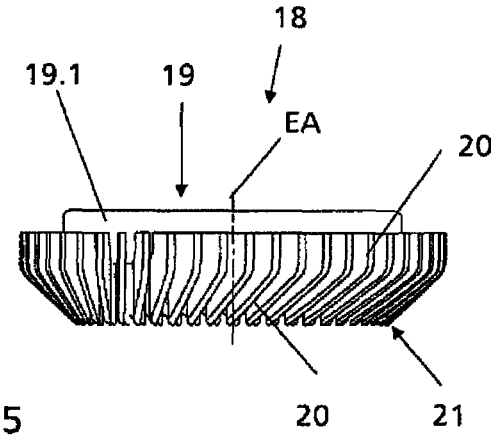
FIGS. 5 and 6 show the insert of FIGS. 3 and 4 in side view and in plan view.

The blades 20 are distributed at equal intervals about the periphery of the ring 19. In addition, each blade 20 projects away from the ring 19 in an axial direction beyond the underside of the ring 19, as is best seen in FIG. 5. The blades 20 collectively form a bladed structure 21.

In the depicted embodiment, planes defined by the blades 20 extend along a direction that is parallel to the insert axis EA. Each blade 20 projects away from the ring 19. At every point on the ring 19 at which a blade 20 merges into the ring 19, there exists a line tangent to the ring 19. The blade 20 defines first and second angles relative to this tangent line. The first and second angles are complementary. In the case in which a blade 20 projects away from the ring in a direction in which the circumferential component is zero, these first and second angles will be right angles. In the more general case in which the blade 20 projects away from the ring 19 in a direction with both radial and circumferential components, the first angle will be acute, and the second angle will be the complementary obtuse angle. In embodiment shown in FIG. 6, the first angle is approximately 45-60°.

The bladed structure 21 defines first and second annular regions of the ring 19. The first annular region 19 projects beyond the top of the bladed structure 21. The second one, which does not, defines an underside of the insert 18.

The underside of the bladed structure 21 forms a conical outer contour that follows the conical interior surface 16 of the tapering lower section of the recess 3.1. On its periphery, the insert 18 forms a circular-cylindrical outer contour that concentrically encircles the insert axis EA. This outer contour follows the circular-cylindrical cross-section of the recess 3.1. Between every pair of interspaced blades 20, the bladed structure 21 forms a flow channel that is open on the periphery and on the underside of the annular insert 18 as well as on the top and on the inside of the annular insert 18 outside the ring 19.

Figure 2:
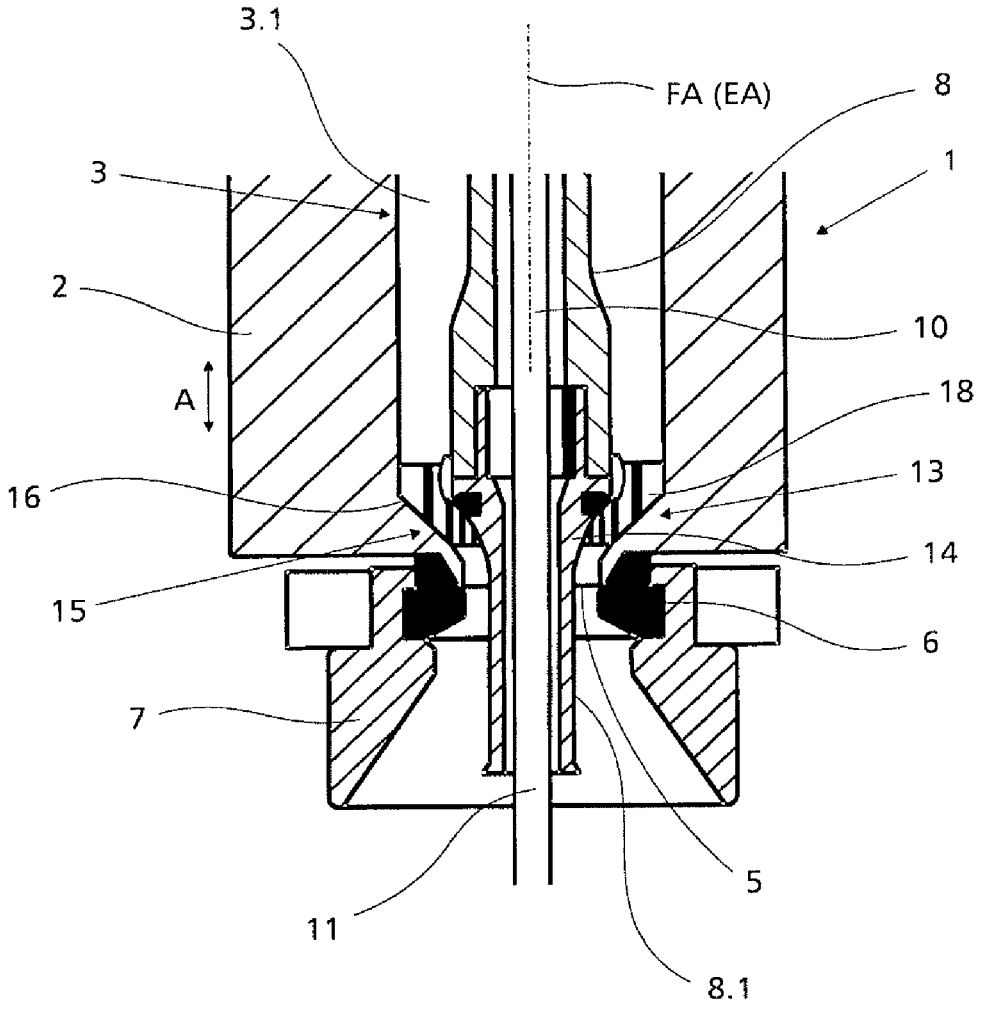
FIG. 2 shows an enlarged partial cross-section through the filling element of FIG. 1.

The annular insert 18 is inserted in the recess 3.1 in such a way that the bladed structure 21 lies with its conical underside against the conical interior surface 16 of the tapering lower section of the recess 3.1 and with its periphery against the interior surface of the recess 3.1 in front of the conically narrowing section of the recess 3.1, as shown in FIG. 2. The insert axis EA is coaxial with the filling-element axis FA. By its section, which has the circular-cylindrical peripheral surface concentrically encircling the filling-element axis FA, the valve body 14 extends into the insert 18. The inside ring diameter of the insert thus follows the outside diameter of the valve body 14. The ring 19 of the insert 18 guides the valve body.

When the liquid valve 13 is in its open state, as shown in FIG. 2, most if not all of the liquid filling material flows out of the liquid channel 3 through the flow channels of the insert 18, and out through the discharge opening 5. In the process, the insert 18 imparts a swirl to the filling material. The swirl has a swirl moment about the filling-element axis FA such that the liquid filling material flows toward and along the inner surface of a container that is being held in a sealed position against the filling element 1.

As liquid filling material flows into the container, it displaces gas already in the container. However, it does so smoothly. As a result, gas smoothly exits the container via the return gas channel 11. This avoids premature wetting of probe 10 with the liquid filling material before a desired fill level has been reached.

Surprisingly, it has also been found that, because it does not move, the insert 18 significantly reduces the residual volume of filling material that is accelerated by the valve body 14 and that moves as the liquid valve 13 moves. This is due, among other things, to the fact that when the liquid valve 13 is open, the liquid filling material leaving the flow channels of the bladed structure 21 flows from the side into the part of liquid channel 3 that is located beneath the opened valve body 14 and that opens into the discharge opening 5. The filling material stream that leaves the flow channels of the bladed structure 21 is therefore interrupted by the valve body 14 moving square to the direction of flow as the liquid valve 13 closes.

The beneficial effects that are achieved with the fixed insert 18 are particularly marked when the blade 20 that form the bladed structure 21 are as closely adjacent to one another as possible with their edges or narrow sides of a circular-cylindrical plane of motion lying on the inside relative to the insert axis EA and oriented parallel to that axis, in which (plane) that section of the valve body 14 that has the circular-cylindrical peripheral surface moves so that at least when the liquid valve 13 is open the entire flow cross-section of the flow channels formed between the blades 20 of the insert 18 is essentially greater than the flow cross-section of a gap that may exist between the peripheral surface of the valve body 14 and the interior surface of insert 18. The distance of the inside edges or narrow sides of blades 20 from this plane of motion is preferably no more than 0.5 mm. During the closing of liquid valve 13, therefore, the radially inside discharge openings of the flow channels formed between the blades 20 are increasingly and tightly occluded to the greatest possible by the valve body 14. Moreover the inside edges or narrow sides of the blades 20 are arranged on a common notional circular-cylindrical surface that is then preferably also the circular-cylindrical surface of the inside of ring 19.

The invention has been described hereinbefore by reference to one embodiment. It goes without saying that numerous variations as well as modifications are possible without departing from the inventive concept underlying the invention.

It is, for example, beneficial if a gas barrier is used in conjunction with a restricting of the return gas flow. Surprisingly a considerable improvement in the fill level accuracy of the filled containers comes about when such a method is applied. There is, in particular, a significant reduction in the standard deviation of the measured actual fill levels.

According to the current level of knowledge, restricting the return gas makes for a more even inflow of the filling material into the container, or a more even, i.e. more turbulence-free, flowing of the filling material through the gas barrier. As a result of these improved flow conditions, the after-flowing or residual flow of filling material is arrested almost immediately and almost completely by the gas barrier at the instant when the desired fill level is reached. The quantity of filling material still flowing after the desired fill level is reached is thus significantly reduced.

Having described the invention, and a preferred embodiment thereof, what is new and secured by Letters Patent is:

1. An apparatus comprising a filling element for filling a plurality of bottles with liquid, said filling element comprising a housing that comprises a recess forming a channel through which said liquid flows, a valve arranged in said channel, said valve comprising a seat and a body, an insert that remains stationary during operation of said filling element, said insert being disposed upstream of said seat and comprising a ring from which project blades that form both said gas barrier and said swirl body, said blades projecting in a direction having a radially outward component and away from said ring and axially downward beyond an underside of said ring, said blades being oriented to impart a swirl to said liquid as said liquid flow's past said blades, and wherein said blades are arranged to arrest residual flow of liquid when said bottle has been filled to a desired level, and an annular opening through which liquid discharges in a direction toward an inner wall of said bottle during filling thereof, wherein each of said blades comprises a bottom edge below the underside of the ring, the bottom edge being transverse to both a radial axis and a longitudinal axis of the housing, and wherein said recess includes a lower conically narrowing section, wherein said bottom edge of each of said blades is disposed in said lower conically narrowing section.

2. The apparatus of claim 1, wherein said blades define Sow channels through which said liquid flows during filling of said bottle, wherein said flow channels define a first cross-sectional area that is available for said liquid to flow through, wherein said body and said ring are contiguous during filling, wherein a gap between said valve body and said ring has second cross-sectional area that is less than said first cross-sectional area.

3. The apparatus of claim 1, wherein all but one edge of each of said blades is exposed to Liquid as said liquid moves past said blades during filling of said bottles.

4. The apparatus of claim 1, wherein spaces between said blades form flow channels for said liquid, said flow channels being perpendicular to a surface defined by said opening.

5. The apparatus of claim 1, wherein said filling element has a filling-element axis, wherein said filling-element axis defines a cylinder having a cylinder axis that is coincident with said filling-element axis, wherein said blades are spaced apart from one another by a space, wherein each of said spaces forms a flow channel between adjacent blades, wherein, each, of said blades defines a blade-defined plane that forms an angle relative to said filling-element axis, and wherein said angle is the same for all of said blade-defined planes.

6. The apparatus of claim 5, wherein said angle is less than ninety degrees.

7. The apparatus of claim 1, further comprising a gas restrictor in a gas path of a return gas, wherein said gas restrictor is configured to cause a restricted flow of said return gas, wherein during said restricted flow, gas flows through said gas restrictor, thereby suppressing turbulence in flow through said gas barrier.

8. The apparatus of claim 1, wherein said blades are oriented with sides thereof being parallel to an axis of said insert.

9. The apparatus of claim 1, wherein said blades are oriented with sides thereof being non-parallel to an axis of said insert.

10. The apparatus of claim 1, wherein each blade projects away from said ring section in a direction with both radial and circumferential components, wherein each blade makes an angle of in the range between 45-60 relative to said ring.

11. The apparatus of claim 1, further comprising a gas tube and a probe, wherein said gas tube comprises an open lower end that extends through said channel and that projects beyond said discharge opening into said bottle and an open upper end that extends upward past a seal at a top of said channel and a probe that determines fill level during filling of said container, wherein said probe extends through said gas tube and projects beyond said lower end of said gas tube, wherein said probe and said gas tube form an annular channel that encircles said probe within said gas tube.

12. The apparatus of claim 1, further comprising an actuator and a gas tube, wherein said actuator actuates said valve by moving said gas tube along a filling-element axis in response to a signal from a probe that extends along a filling-element axis and into said container.

* * * * *